US005772931A

United States Patent [19]

Farrand

[11] Patent Number: 5,772,931

[45] Date of Patent: Jun. 30, 1998

[54] SLAG COATING PROCESS

[75] Inventor: Bruce Langley Farrand, Hamilton, Canada

[73] Assignee: Dofasco Inc., Hamilton, Canada

[21] Appl. No.: 771,406

[22] Filed: Dec. 20, 1996

[51] Int. Cl.[6] ..... F27D 1/16

[52] U.S. Cl. ..... 264/30; 266/44; 266/281

[58] Field of Search ..... 264/30; 266/44, 266/281

[56] References Cited

U.S. PATENT DOCUMENTS

| | | | |
|---|---|---|---|
| 2,361,416 | 10/1944 | Reece . | |
| 2,424,825 | 7/1947 | Hogan | 264/30 |
| 3,351,460 | 11/1967 | Demaison | 264/30 |
| 3,897,244 | 7/1975 | Murton . | |
| 3,994,676 | 11/1976 | Strimple | 264/30 |
| 4,612,046 | 9/1986 | Orcutt . | |
| 4,735,398 | 4/1988 | Denier | 264/30 |

FOREIGN PATENT DOCUMENTS

| | | | |
|---|---|---|---|
| 59-222515 | 12/1984 | Japan | 264/30 |

*Primary Examiner*—James Derrington

[57] ABSTRACT

A process for coating the walls of a steelmaking vessel with slag between heats to protect the refractory liming of the vessel uses coolant in the form of recycled slag as a substitute for fluxes such as lime and dolime to cool and thicken slags which are otherwise too fluid to produce an acceptable slag coat.

12 Claims, 2 Drawing Sheets

SLAG COATING PROCESS

FIELD OF THE INVENTION

This invention relates to steelmaking, and more particularly relates to a process for protecting the refractory lining of a steelmaking vessel.

BACKGROUND OF THE INVENTION

Steelmaking furnaces are normally lined with a refractory material comprising a mixture of oxides of which the composition is selected to be compatible with the steel composition being produced. Because of harsh physical conditions inherent in basic oxygen steelmaking (BOF), high operating temperatures and turbulence from oxygen injection and inevitable chemical imbalances resulting in oxidation of the refractory brick, the furnace lining has a limited life and must periodically be replaced. Such maintenance of the furnace lining is scheduled to take place at predetermined intervals, for example, after 3,000–4,000 heats have been tapped from the furnace and more frequently for maintenance of the bottom of the furnace. Nevertheless, the time required to strip the old refractory brick from the furnace and to replace it is an interruption which significantly affects production and which therefore is very costly to the steelmaker.

The steelmaking industry has long recognized the desirability of adopting steelmaking practices which will minimize wear of the refractory lining, for example, by adjusting the depth of an oxygen lance inside the furnace during the heat or by adjusting the fluxing additions to the supernatant slag to create a slag composition which is chemically compatible with the refractory and which does not compromise the metallurgical capacity of the slag. For example, U.S. Pat. No. 2,361,416 to Reece teaches the use of a fluxing material comprising a substantial amount of slag produced from a previous operation of the steelmaking vessel, the recycled slag already containing ingredients removed from the refractory lining and therefore having a reduced capacity to remove still more ingredients from the refractory than a fresh slag made entirely of virgin raw material such as lime and dolime. Other methods of extending the life of the lining involve selective repair of weak spots in the lining with additional refractory materials.

An entirely different practice relates to the conditioning of the slag after a heat has been tapped from the furnace or steelmaking vessel to create a slag which is suitable for creating a protective coating on the refractory lining before any scrap and hot metal are added to the furnace for refining. The suitability of the slag to create such a protective slag coating is in part determined by the chemistry of the slag. However, the chemistry alone does not determine whether the slag will be good for slag-coating the furnace. Viscosity of the slag is a key property required for the slag to be acceptable for slag coating. The slag condition may range between a fluid slag having a low viscosity to a mostly solid slag. The most desirable slag for slag coating has sufficient fluidity to flow over the surface of the furnace lining while being viscous enough to stick.

Typically, the slag condition resulting from steelmaking is too fluid to provide a good protective coating and coolant in the form of fluxes, such as lime and dolime, are added to increase the viscosity of the slag. The flux additions do not completely melt or dissolve into the slag as there is insufficient time, energy and mixing. The primary result is simply to cool the slag and increase its viscosity.

While the addition of flux such as dolime performs well to produce an acceptable slag coat, the Applicant has discovered that the resultant slag becomes contaminated by the presence of unreacted dolime, thereby making it less suitable for use in other applications, notably for use as an asphalt aggregate.

The paramount objective of a steelmaker has always been to produce good steel with relatively little attention being devoted to producing a high-quality slag by-product which is suitable for post-steelmaking operations. The disposal of slag has become increasingly unacceptable and much effort has been devoted to the sale of slag for use in non-steelmaking applications, with limited recycling into steelmaking operations. Inherently, recycling must be limited since fresh fluxes are required to provide the necessary refining capacity in the slag.

One significant end use for slag in non-steelmaking applications has been as an aggregate for road surfacing. It is anticipated that there is sufficient demand for such aggregate to consume all waste slag production from the steel industry in North America. Unfortunately, the use of such slag aggregate on certain roads has been restricted by several authorities because of poor performance evidenced by pavement cracking, blistering, and other such physical defects.

An object of this invention is to produce a slag which is acceptable as a slag coat to protect the furnace lining and which will also be useful in post-steelmaking operations.

SUMMARY OF THE INVENTION

In accordance with this invention, there is provided a slag coating process for coating a steelmaking vessel with slag between heats to protect a refractory lining of the vessel, the process comprising the steps of:

assessing the volume and viscosity of slag remaining in the vessel after a tap of refined steel;

adding a predetermined quantity of coolant comprising cold slag formed from a previous operation of a steelmaking vessel, said quantity being adapted to cool the volume of slag remaining in the vessel and to produce a slag having a viscosity sufficient to coat the refractory lining;

rocking the steelmaking vessel to distribute the slag over the refractory lining; and dumping excess slag from the steelmaking vessel.

BRIEF DESCRIPTION OF THE DRAWINGS

In order that the invention may be more clearly understood, the process according to the invention is described in detail below, with reference to the accompanying drawings in which.

DETAILED DESCRIPTION WITH REFERENCE TO THE DRAWINGS

Hot metal or pig iron from the blast furnace will typically be refined in batches in a basic oxygen furnace (BOF) or variation thereof such as Dofasco's KOBM where oxygen is introduced into the melt through a top lance and via bottom tuyeres. The nature of the steelmaking vessel, and of the steel refining process adopted to produce the desired grade of steel, are not material to the process of the invention.

The slag coating process according to the invention will be described with reference to a KOBM furnace where Applicant conducted experimental trials. However, it will be understood that the process will find application in other batch refining furnaces where slag coating to protect a refractory lining is desirable.

Figure 1:
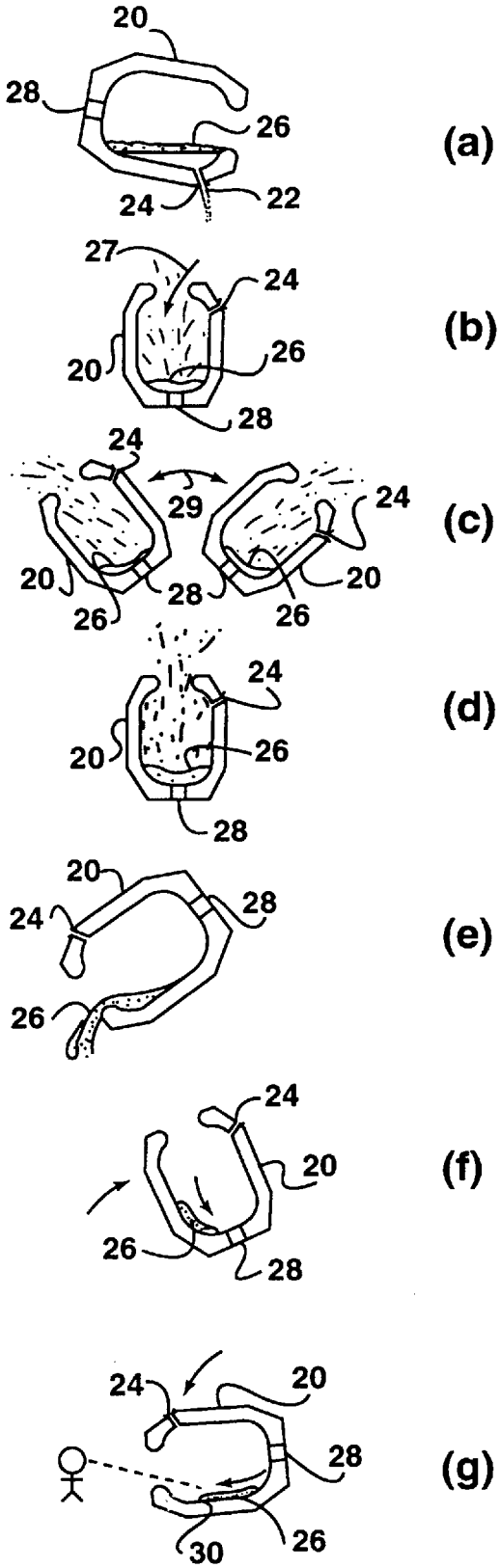
FIG. 1 is a schematic flow chart showing the process according to the invention.

A KOBM furnace designated by reference numeral 20 in FIG. 1 is illustrated schematically in a tilted position at (a) with refined steel 22 being tapped through a taphole 24 in the side wall of the furnace. A supernatant layer of slag 26 is visible to an operator through the mouth of the furnace.

The operator's first task is to make a visual assessment of the slag condition, namely to determine its fluidity, and also to estimate its volume. KOBM tap slag can vary from heavy and solid to very fluid. The best slag coating is achieved with a "gummy" slag which is thick and viscous, sticking well to the furnace lining and yet fluid enough to spread and provide good coverage.

If the slag is excessively heavy, it will be very viscous and nearly solid. A "heavy slag" does not stick to the furnace lining and adding coolant cannot improve it. Such a slag must simply be dumped into a slag pot for further processing. It is unsuitable for forming a slag coat.

Where the slag is too fluid to stick well to the furnace lining, it may be thickened by adding coolant. Cooling the slag increases its viscosity, making it more suitable for slag coating. Thus, adding coolant to a "creamy slag" will transform it into a more viscous "gummy slag". "Fluid slags" typically result from a high FeO content in the slag and have a water-like consistency. Over-oxidized heats can sometimes produce a "foamy slag" having a gassy consistency and additional coolant will be required to produce a desirable "gummy slag".

Generally, as much slag as possible is left in the furnace for slag coating. If there is too much slag, some will be dumped out after tapping. The more fluid a slag is, the more slag is dumped. The amount of slag retained in the furnace will vary with the size of the furnace. In the case of Applicant's 300-tonne furnace, 10–20 tonnes of slag was found to be suitable for good slag coating.

FIG. 1(*b*) shows the furnace 20 returned to an upright position ready to take a charge of coolant, generally indicated by reference numeral 27. The volume of coolant added is dependent on the condition of the slag and is added in the amounts indicated in Table 1 (for a furnace having a capacity of 300 tonne).

The coolant 27 will preferably comprise cold slag recycled from previous operations of the KOBM furnace. The recycled slag will have been crushed and processed to remove any residual metallics. A size fraction of slag having a nominal mesh size of 1¼ in×⅝ in (32 mm×16 mm) is selected for recycling as coolant into the slag coating process and will have been dried, as is common for flux additions required during steelmaking. While the size fraction of cold slag is not critical to the process, good mixing of the coolant and the slag is important and the size fraction used is selected accordingly. The chemical composition of the slag being recycled is not important to the slag coating process and there is no selection of the slag according to its chemistry or the tap carbon of the steel grade which was being refined when the slag was originally produced.

TABLE 1

| Slag | Amount of coolant if only using | Amount of coolant if using cold slag and crushed brick | |
|---|---|---|---|
| condition at tap | cold slag (kg) | Cold slag (kg) | Crushed brick (kg) |
| Heavy | 0 | 0 | 0 |
| Gummy | 0 | 0 | 500 |

TABLE 1-continued

| Slag | Amount of coolant if only using | Amount of coolant if using cold slag and crushed brick | |
|---|---|---|---|
| condition at tap | cold slag (kg) | Cold slag (kg) | Crushed brick (kg) |
| Creamy | 1000–2000 | 500–1500 | 500 |
| Foamy | 1500–2500 | 1000–2000 | 500 |
| Fluid | 2000–3000 | 1500–2500 | 500 |

If crushed furnace brick salvaged from a furnace relining operation is in storage, the brick may, on occasion, be used to supplement the cold slag used as coolant. Such brick does contribute to the formation of a foamy slag and the amount used is therefore limited to a maximum of 500 kg per heat. Crushed furnace brick is rarely added alone and is usually added to supplement cold slag additions. It will be noted from Table 1 that the recommended amount of cold slag additions is correspondingly reduced by 500 kg where crushed brick is used as coolant.

After coolant has been added, the furnace is rocked, as indicated by arrow 29, preferably at least three times, to mix the coolant into the slag and to distribute the slag over the furnace lining. Spraying of the slag during rocking will improve the distribution of the slag. The rocking brings the furnace axis to an angle of between +/−60° from the vertical as illustrated schematically at FIG. 1(*c*). The furnace is returned to an upright position shown in FIG. 1(*d*) where the furnace axis is between +/−10° from the vertical and slag is sprayed for a period of one minute on to the charge side or the top side of the furnace, as the case may be.

In Applicant's KOBM furnace, spraying of the slag is performed by blowing nitrogen through bottom tuyeres 28 of the furnace 20. Spraying of the slag may also be carried out with lances which may need to be adjusted for greater penetration into the furnace. The process according to the invention may however be carried out without spraying, if means to do so are not available.

Excess slag is dumped from the furnace through the mouth into slag pots for subsequent processing. In the slag pots, and during transfer to the slag pots, the quality or condition of the slag can be visually assessed to judge whether the coolant addition has been successful. This will be used as a guide for making adjustments to the quantity of coolant additions to be made in subsequent heats. This step of the process is shown in FIG. 1(*e*).

If the quality of the slag is deemed to have been good, a quantity of slag 26 is reserved in the furnace 20 to protect the charge belly 30 for the next heat. The aim is to leave enough slag for a layer 3 to 4 inches (7 to 10 cm) thick in the charge belly. If the slag layer is too thick, it will not freeze in the time available between heats and the slag will slide out of the belly when scrap metal is charged for the next heat.

To position the reserved slag 26 in the low spot of the charge pad, the furnace is raised to 330° as shown in FIG. 1(*f*) and the slag is allowed to slide to the bottom of the furnace. The furnace is then lowered to 250°–270° as shown in FIG. 1(*g*) to position the slag in the middle of the belly. The furnace is left in this position until the next charge.

Figure 2:
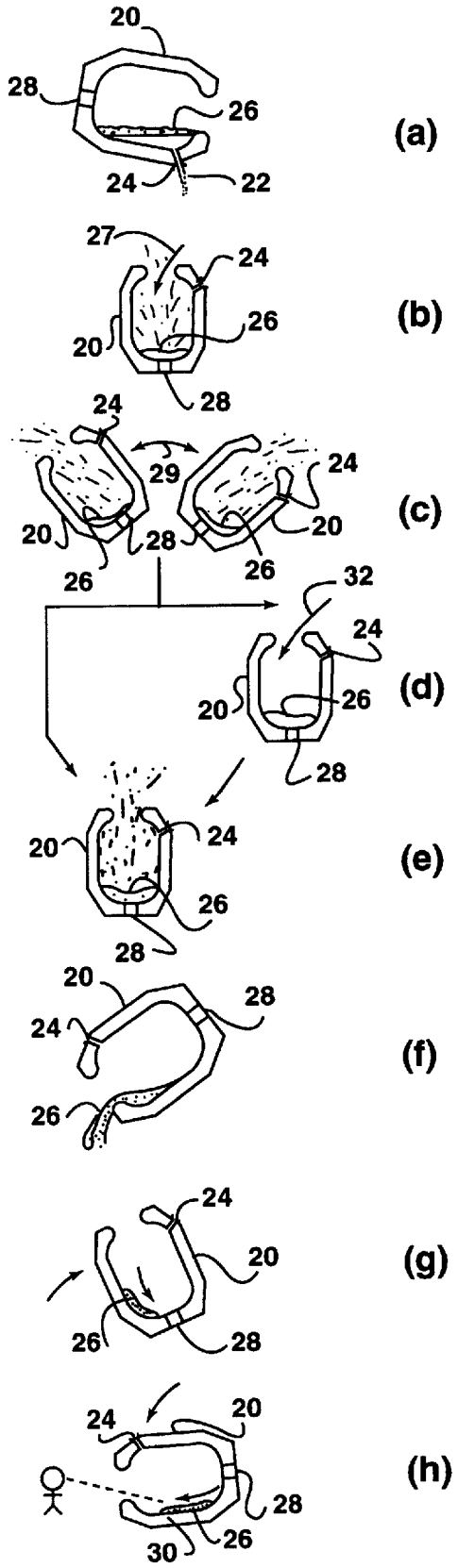
FIG. 2 is a similar flow chart showing a variation of the process according to the invention.

The entire process described above typically requires less than three minutes to complete. If time permits and suitable equipment is available, the process is modified to spray slag during the coolant addition 27, as shown schematically in FIG. 2 at (*b*). The rocking shown at FIG. 2(*c*) will usually exceed three oscillations of the furnace and additional coolant 32 may be added as shown at 2(*d*) if the slag still appears to be too fluid to adhere to the furnace lining and provide a good slag coat. After the furnace is brought substantially upright as shown at 2(*e*), optionally without any additional coolant 32, the slag is sprayed for a period of two minutes to provide a better distribution of slag onto the furnace lining so as to create a good slag coat. The process illustrated in FIG. 2 is otherwise similar to that shown in FIG. 1 and like numerals have been used to designate like parts.

A good slag coat is characterized by a slag build-up all over the furnace bottom and walls, such that all brick is concealed. This is usually not achieved until several successive heats have been processed, each having an ideal gummy slag formed at the end of the tap.

I claim:

1. A slag coating process for coating a steelmaking vessel with slag between heats to protect a refractory lining of the vessel, the process comprising the steps of:

assessing the volume and viscosity of slag remaining in the vessel after a tap of refined steel;

adding a predetermined quantity of coolant comprising cold slag formed from a previous operation of a steelmaking vessel, said quantity being adapted to cool the volume of slag remaining in the vessel and to produce a slag having a viscosity sufficient to coat the refractory lining;

rocking the steelmaking vessel to mix and distribute the slag over the refractory lining; and dumping excess slag from the steelmaking vessel.

2. Process according to claim 1 in which slag is dumped from the steelmaking vessel prior to adding cold slag.

3. Process according to claim 1 in which a second predetermined quantity of cold slag is added to the steelmaking vessel after rocking the steelmaking vessel.

4. Process according to claim 1 in which the slag is sprayed prior to rocking the steelmaking vessel.

5. Process according to claim 1 in which the slag is sprayed while the steelmaking vessel is rocked.

6. Process according to claim 1 in which the steelmaking vessel is brought substantially upright after rocking, and slag is sprayed onto the refractory lining.

7. Process according to claim 1 in which a predetermined quantity of slag is left in the steelmaking vessel to coat the charge belly of the steelmaking vessel after dumping excess slag.

8. Process according to claim 1 in which the coolant comprises a predetermined quantity of crushed furnace brick in addition to said cold slag to chill and thicken the slag, the quantity of cold slag being correspondingly reduced.

9. Process according to claim 1 in which the quantity of coolant added to a 300 tonne steelmaking vessel is between 1,000 kg and 3,000 kg of cold slag.

10. Process according to claim 8 in which the quantity of crushed furnace brick added to a 300 tonne steelmaking furnace does not exceed 500 kg.

11. Process according to claim 3 in which the second predetermined quantity of cold slag addition to a 300 tonne steelmaking furnace does not exceed 1,000 kg.

12. Process according to claim 1 in which the cold slag is added in crushed form having a nominal mesh size of 1¼ in×⅝ in (32 mm×16 mm) selected to improve mixing of coolant into slag.

* * * * *

UNITED STATES PATENT AND TRADEMARK OFFICE

CERTIFICATE OF CORRECTION

PATENT NO. : 5,772,931
DATED : June 30,1998
INVENTOR(S) : Bruce Langley Farrand

It is certified that error appears in the above-identified patent and that said Letters Patent is hereby corrected as shown below:

In Claim 10, line 3, replace "furnace" with --vessel--;

in Claim 11, line 3, replace "furnace" with --vessel--.

Signed and Sealed this

Sixth Day of July, 1999

*Attest:*

Q. TODD DICKINSON

*Attesting Officer*

*Acting Commissioner of Patents and Trademarks*